United States Patent [19]

Bando et al.

[11] 4,292,613

[45] Sep. 29, 1981

[54] FLAT-SHAPED ELECTROMAGNETIC RELAY HAVING MULTIPLE CONTACTS

[75] Inventors: Yoshihide Bando, Kyoto; Toshiki Tanaka, Yawata, both of Japan

[73] Assignee: Omron Tateisi Electronics Co., Kyoto, Japan

[21] Appl. No.: 67,225

[22] Filed: Aug. 17, 1979

[30] Foreign Application Priority Data

Sep. 8, 1978 [JP] Japan ..... 53-110852

[51] Int. Cl.[3] ..... H01H 45/02; H01H 45/14

[52] U.S. Cl. ..... 335/128; 335/106; 335/202

[58] Field of Search ..... 335/202, 106, 128, 203, 335/107

[56] References Cited

U.S. PATENT DOCUMENTS

| | | | |
|---|---|---|---|
| 3,544,930 | 12/1970 | Sauer | 335/202 |
| 3,688,229 | 8/1972 | Bloch | 335/128 |
| 3,889,087 | 6/1975 | Graeff | 335/106 |
| 3,906,416 | 9/1975 | Sprando | 335/128 |
| 3,978,439 | 8/1976 | Thomson | 335/203 |

*Primary Examiner*—Harold Broome

*Attorney, Agent, or Firm*—Wegner & Bretschneider

[57] ABSTRACT

An electromagnetic relay comprising a flat electromagnet, a movable plate member having on a lower surface a plurality of projections and a contact circuit device as stacked up together, said contact circuit device including a plurality of contact switching members each of which consists of a single movable blade and a single stationary contact, said movable blade being biased by the projections in accordance with their movement so as to provide a switching operation in cooperation with the corresponding stationary contact.

15 Claims, 12 Drawing Figures

FLAT-SHAPED ELECTROMAGNETIC RELAY HAVING MULTIPLE CONTACTS

BRIEF SUMMARY OF THE INVENTION

The present invention relates to a flat-shaped electromagnetic relay providing a plurality of contact open-and-close operations, and more particularly to a thin flat-shaped electromagnetic relay of stacked-up construction having a flat-shaped electromagnetic device and a flat-shaped contact circuit device driven by the electromagnetic device.

The conventional flat-shaped electromagnetic relay for use on printed circuit boards is essentially such that an electromagnetic device and a contact device of a hinge-type relay are horizontally assembled in side-by-side relationship or a stamped plate is employed for use as a magnetic circuit. Since such relay employs the contact device wherein a pair of make and break contacts are disposed facing each other with respect to a common contact therebetween, it has the disadvantage that the height of the relay cannot be smaller than a certain height, e.g. 10 mm, because such contact device requires a certain minimum height. If it is attempted to reduce the height, the relay has had to be increased in lateral dimensions. A packed reed relay for use on a printed circuit board also is well known which is constructed in the same configuration as an IC package. Since such a reed relay normally provides a make-contact only in response to energization thereof and may cause a characteristic stick accident between contacts, the reed relay is restricted in use.

The present invention, on the other hand, enables an electromagnetic relay to be constructed within desired extremely small volumetric dimensions, such as an IC package 8mm in height, and to provide precise multiple switching operations by forming the relay of thin flat-shaped electromagnetic and contact circuit devices as stacked up together, said contact circuit device comprising a plurality of contact switching members each of which consists of a single movable blade and a single stationary contact so as to ensure a small overall height.

It is, therefore, a primary object of the present invention to provide an electromagnetic relay which is small in size, especially in height, and is easy to assemble.

It is a further object of the present invention to provide an electromagnetic relay which comprises a flat-shaped electromagnetic device and a flat-shaped contact circuit device.

It is a still further object of the present invention to provide an electromagnetic relay having a plurality of contact switching members each consisting of a single movable blade and a single stationary contact wherein the contact switching members are driven to move in a predetermined relation.

It is another object of the present invention to provide an electromagnetic relay wherein each contact switching member performs an independent switching operation without interference with neighboring contact switching members and is shielded from external electric noise.

It is still another object of the present invention to provide an electromagnetic relay which is highly resistant to external forces acting thereon and may be of a hermetic seal.

BRIEF DESCRIPTION OF DRAWINGS

Other objects as well as the numerous advantages of the electromagnetic relay according to the present invention will become apparent from the following detailed description and the accompanying drawings, in which.

DETAILED DESCRIPTION

Figure 1:
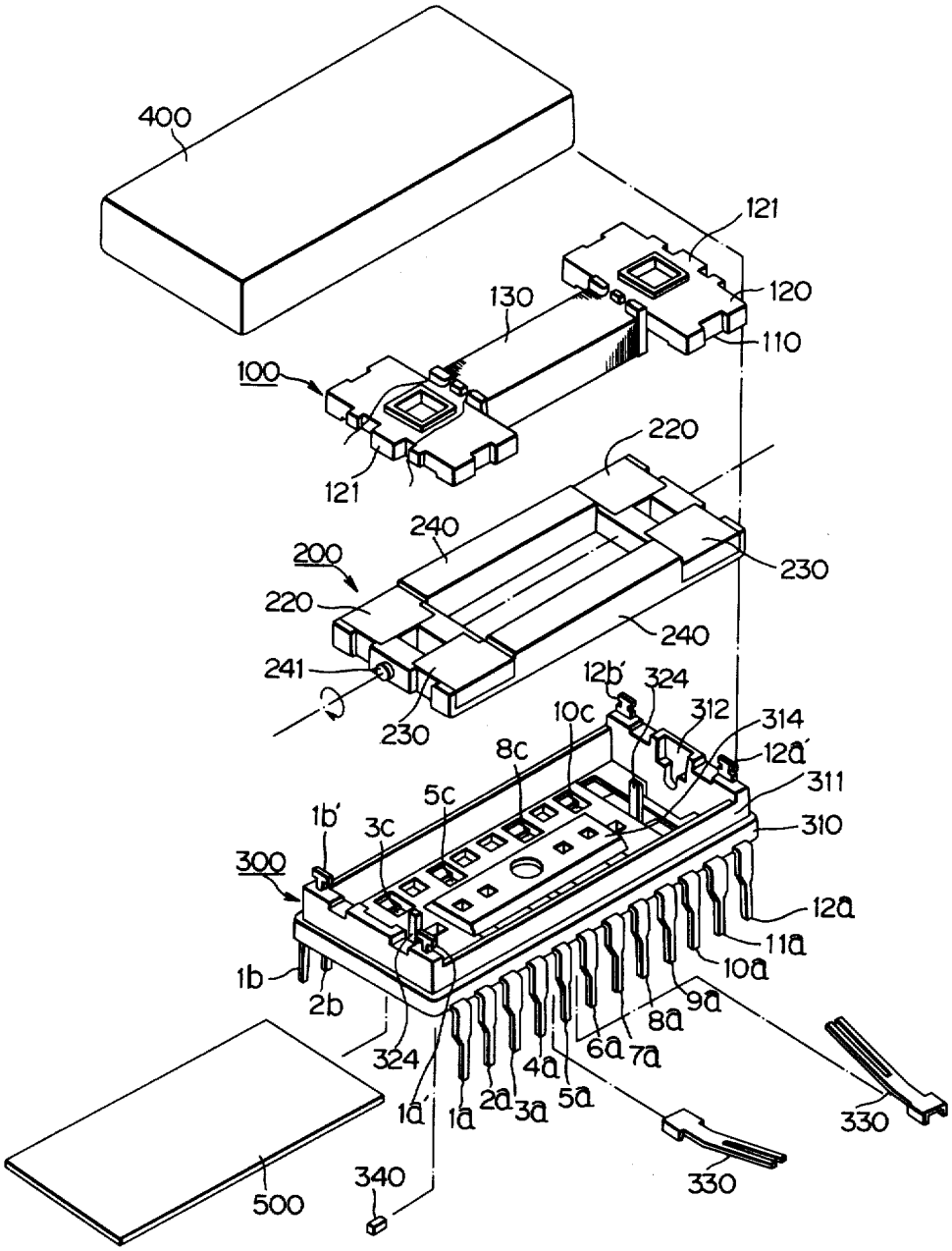
FIG. 1 is a perspective disassembled view showing an electromagnetic relay as one embodiment of the present invention.
Figure 2:
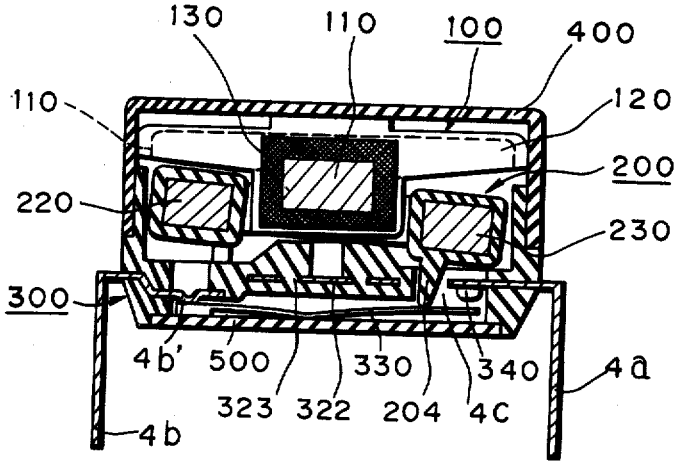
FIG. 2 is a front assembled sectional view showing the electromagnetic relay of FIG. 1.
Figure 3:
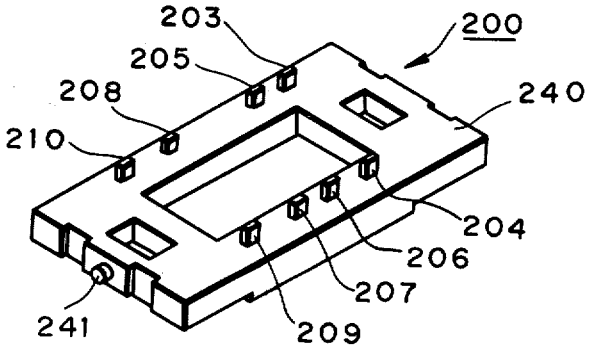
FIG. 3 is a perspective view showing a lower surface of a plate member of the relay of FIG. 1.

Referring, now, to FIG. 1 and FIG. 2, there is shown an electromagnetic relay as one embodiment of the present invention. The electromagnetic relay is of a stacked-up construction having a flat electromagnetic 100, a movable plate member 200, and a flat contact circuit device 300. The electromagnet 100 and the plate member 200 form a flat electromagnetic device. A cover 400 is an upper cover member, the inner surface of which is adapted to contact a peripheral side wall 311 of a base 310. The electromagnet 100 consists of I-shaped magnetic core 110 which is covered with a molded plastic 120, and a coil 130 which is wound on a spool formed in a center portion of the core 110. The plate member 200 includes a permanent magnet 220, a soft magnetic bar 230, a pair of stub shafts 241 and a molded plastic carrier 240 carrying the magnet 220, the bar 230 and the shafts 241. The permanent magnet 220 may be a permanent magnet rod as a whole, or a soft magnetic bar carrying on a middle portion thereof a permanent magnet piece. The plate member 200 is mounted on the base 310 so as to be swingable with respect to the shafts 241. The shafts 241 are positioned at both ends of the carrier 240 in the centerline between the magnet 220 and the bar 230, and are swingably supported by a pair of recesses 312 formed in an inner surface of the side wall 311. The recesses 312 also receive the ends 121 of the electromagnet 100 which are positioned above the plate member 200. As shown in FIG. 3, the plate member 200 has on the lower surface thereof eight projections 203 to 210 which are positioned in parallel and spaced-apart side portions thereof.

Figure 9:
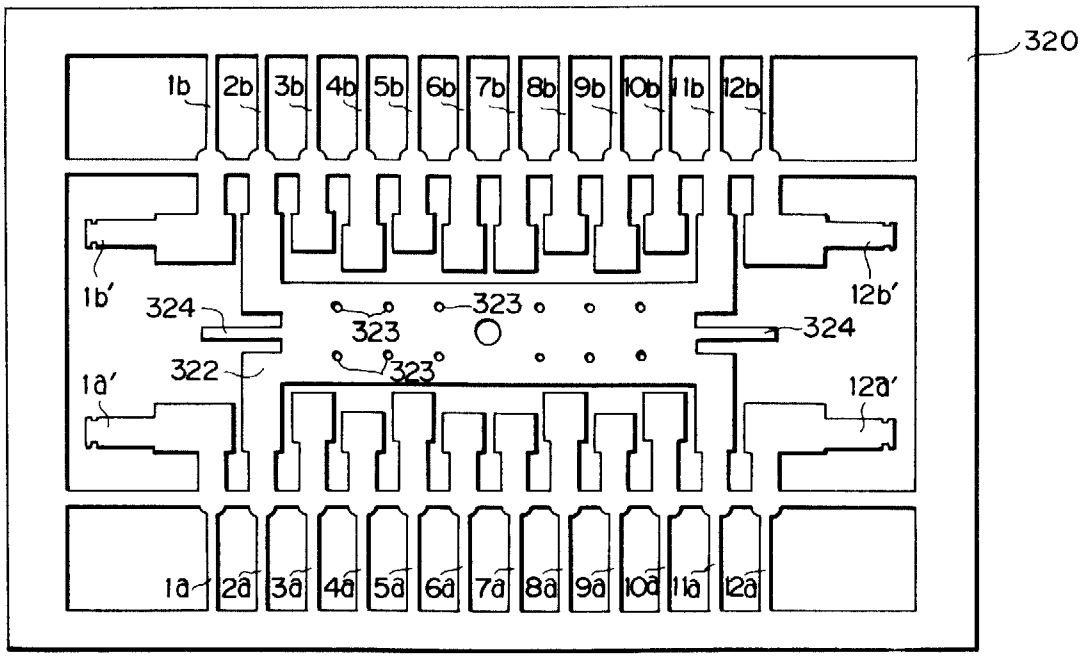
FIG. 9 is a plan view of a lead frame for use in the device of FIG. 4.

In FIGS. 4,5,6,7,and 8, there is shown the contact circuit device 300 as semi-assembled before movable contact members 330 are assembled therein, and external terminals 1*a* to 12*a* and 1*b* to 12*b* are cut out from a lead frame 320. The lead frame 320 is made from single sheet of metal, e.g., phosphor bronze, by stamping as shown in FIG. 9. The base 310 is a molded plastic which is molded on the lead frame 320. The inner end of each of external terminals 1*a* to 12*a* and 1*b* to 12*b* is extending inwardly of the base 310 and is exposed to an inner compartment 313 thereof so as to carry on the lower surface of the base 310 the movable contact member 330 or a stationary contact member 340. Some of the movable contact members 330 are fixed to ends 3*a*', 5*a*', 8*a*', and 10*a*' of terminals 3*a*, 5*a*, 8*a*, and 10*a* in one direction and the remaining members 330 to ends 4*b*', 6*b*', 7*b*', and 9*b*' if terminals 4*b*, 6*b*, 7*b*, and 9*b* in the opposite direction, by spot welding. Stationary contact members 340 are respectively fixed to inner ends 3*b*', 4*a*', 5*b*', 6*a*', 7*a*', 8*b*', 9*a*', and 10*b*' of the corresponding terminals. The base 310 has eight through holes 3*c*, 4*c*, 5*c*, 6*c*, 7*c*, 8*c*, 9*c*, and 10*c* adjacent to the stationary contact members 340, so that the projections 203 to 210 may depress the corresponding movable contact members 330 through the holes 3*c* to 10*c*.

Figure 10:
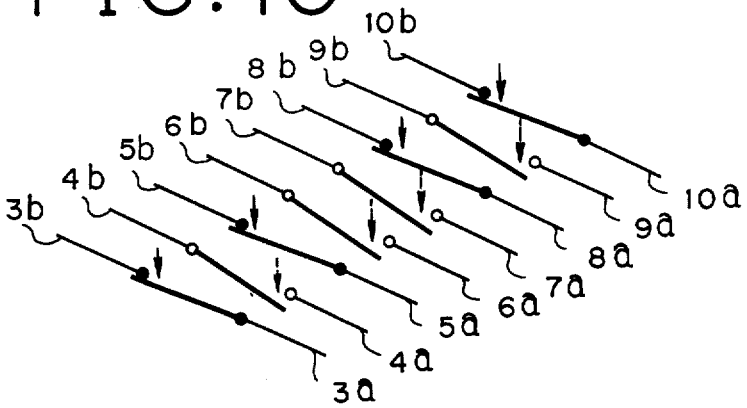
FIG. 10 is a schematic illustration showing construction of contact switching members of the relay of FIG. 1.

As shown in FIG. 2, when the coil 130 is not excited, the permanent magnet 220 will be attracted by the core 110 into contact therewith, and the projections 204, 206, 207, and 209 will downwardly depress the corresponding movable contact members 330. When the coil 130 is excited, the core 110 will be magnetized in a reverse direction so that the permanent magnet 220 repels the core 110 and the soft magnetic bar 230 is attracted by the core 110, with the result that the projections 203, 205 208, and 210 will downwardly depress the corresponding movable contact members 330. As shown in FIG. 10, the relay of FIG. 1 provides a contact construction wherein break-contacts (i.e. contact circuit opened upon energization) can be formed between the external terminals 3*a* and 3*b*, 5*a* and 5*b*, 8*a* and 8*b*, and 10*a* and 10*b*, and make-contacts, (i.e. a contact circuits closed upon energization) can be formed between the external terminals 4*a* and 4*b*, 6*a* and 6*b*, 7*a* and 7*b*, and 9*a* and 9*b*, respectively. The arrow marks in solid line of FIG. 10 show the biasing forces applied to the movable contact members 330 when the coil 130 is excited, and the arrow marks in broken line show the biasing forces applied to the members 330 when the coil 130 is not excited.

External terminals 1*a*, 1*b*, 12*a*, and 12*b* are coil input terminals which are electrically connected to the coil 130 and also to diodes 308 and 309 for absorbing the back electromotive force. The diodes 308 and 309 are mounted in grooves 301 and 302 formed in the base 310. External terminals 2*a*, 2*b*, 11*a*, and 11*b* are ground terminals which, as shown in FIG. 9, are connected to a shield plate 322 and tongues 324. The tongues 324 are adapted to engage with the core 110 as assembled. The grounded core 110 is for use as a shield member which can shield the contact circuit device 300 from external magnetic noise in low frequency. The grounded shield plate 322 is for use as an electrostatic screening member and high frequency magnetic shield member so as to shield the contact members of the device 300 from the external noise. The shield plate 322 having a plurality of apertures 323 which are filled with a portion of the resin base 310 not only provides tight contact between the thin base 310 and the plate 322, but also reinforces the base 310 as a whole.

Figure 12:
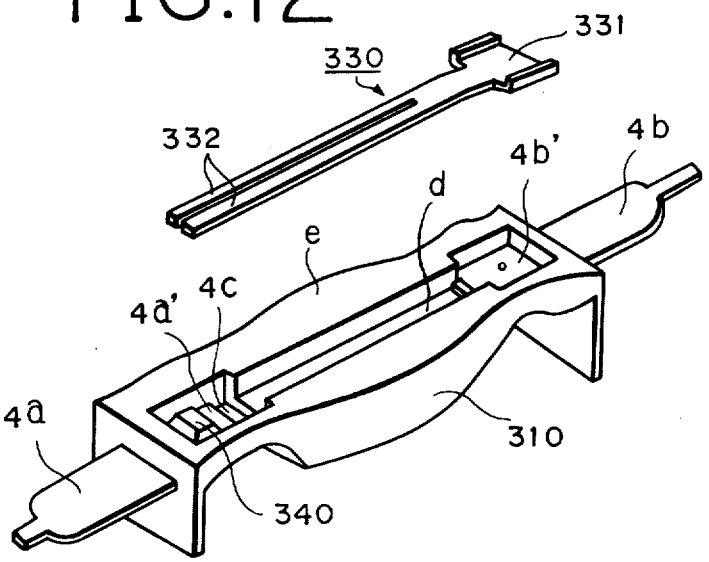
FIG. 12 is a perspective segmentary view as semi-assembled showing a contact switching member of the contact circuit device shown in FIG. 1.

In FIG. 12, there is shown a portion of the semi-assembled contact circuit device 300. The base 310 has on the lower surface a plurality of walls e and grooves d to provide an electrically isolated free space or compartment between the movable and stationary contact members 330 and 340 of each contact pair. The movable contact members 330 each consists of a base 331 and movable twin-contacts 332. The base 331 is fixed to the end 4*b*' of the terminal 4*b* by spot welding, and the contact member 330 is flexably mounted on the base 310. In assembling, the member 330 can be easily positioned in the base 310 by fitting the base 331 to the groove d. Each wall e of the base 310 is adapted to contact a cover plate 500 so as to provide a closed compartment. By sealing the joint of the base 310 and cover members 400 and 500 with adhesive material, the relay may be hermetically sealed as a whole. If the plate 500 is made of magnetic material, the relay may be magnetically shielded.

Figure 11:
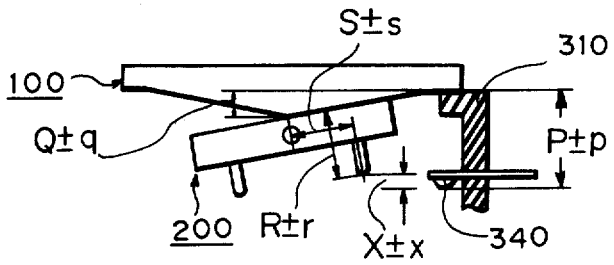
FIG. 11 is a schematic illustration showing the movement of the plate member of FIG. 3.

Since the relay is of the stacked-up construction having electromagnet 100, plate member 200, and contact circuit device 300, the major dimensions of the relay mainly depend upon the accuracy of metal moulds for molding plastics. As shown in FIG. 11, and error x of stroke X of the projection from the original position of FIG. 11 to an operating position, where the movable contact member disengages from the stationary contact member, is mainly defined by errors p, q, r, and s of the metal moulds. Stated differently, the relay may be precisely and easily assembled without adjustment.

The base 310 has on the upper surface a rib 314 in the direction crossing the walls e on the lower surface thereof at right angles, so that the thin base 310 may be reinforced.

Figure 4:
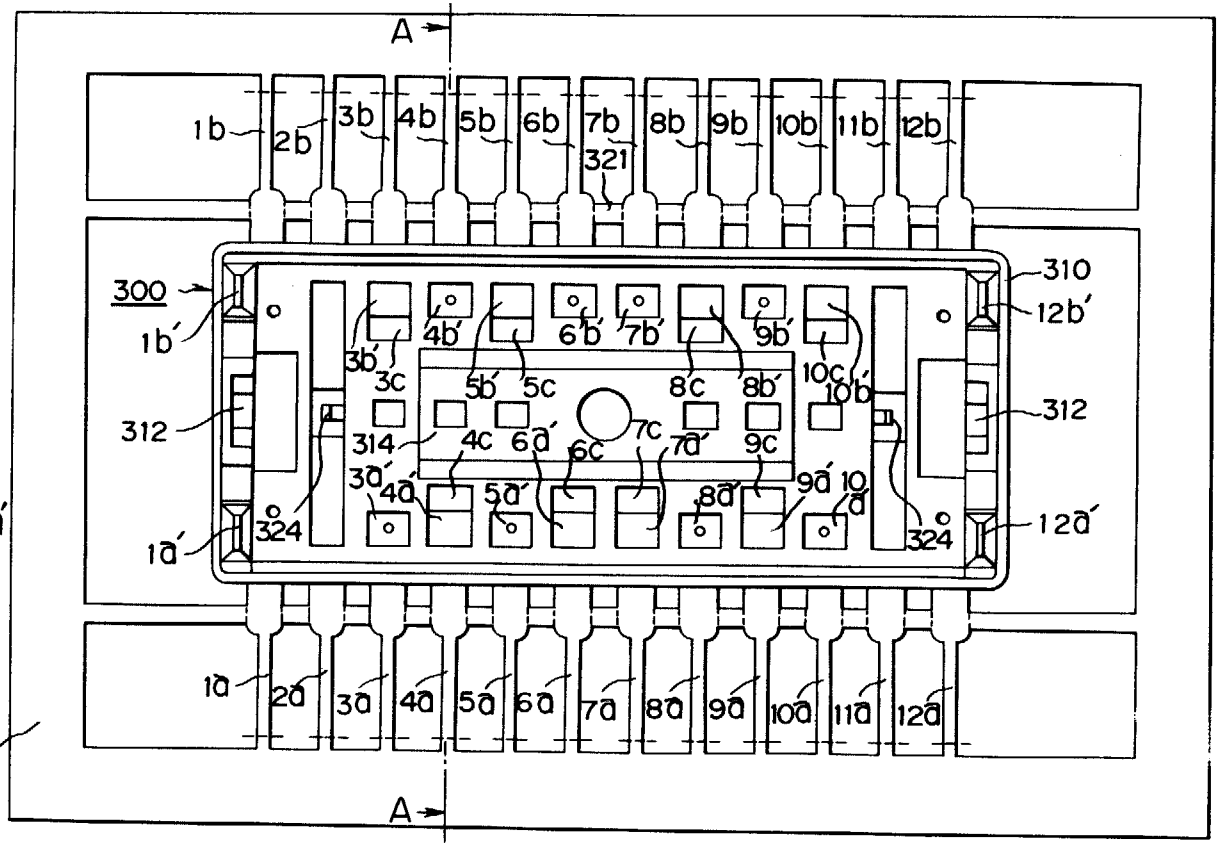
FIG. 4 is a top plan semi-assembled view showing a contact circuit device of the relay of FIG. 1.
Figure 5:
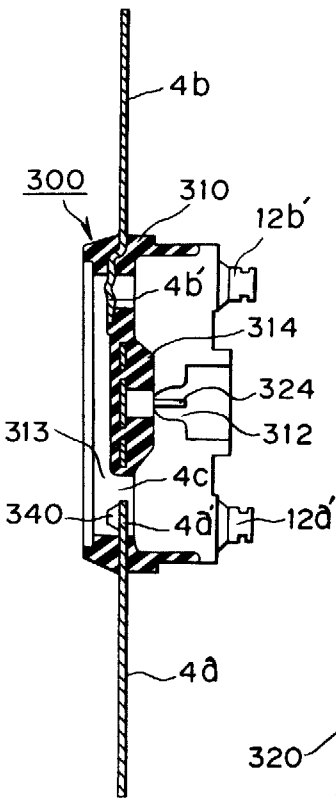
FIG. 5 is a front sectional view taken along the line A-A of the device FIG. 4.
Figure 6:
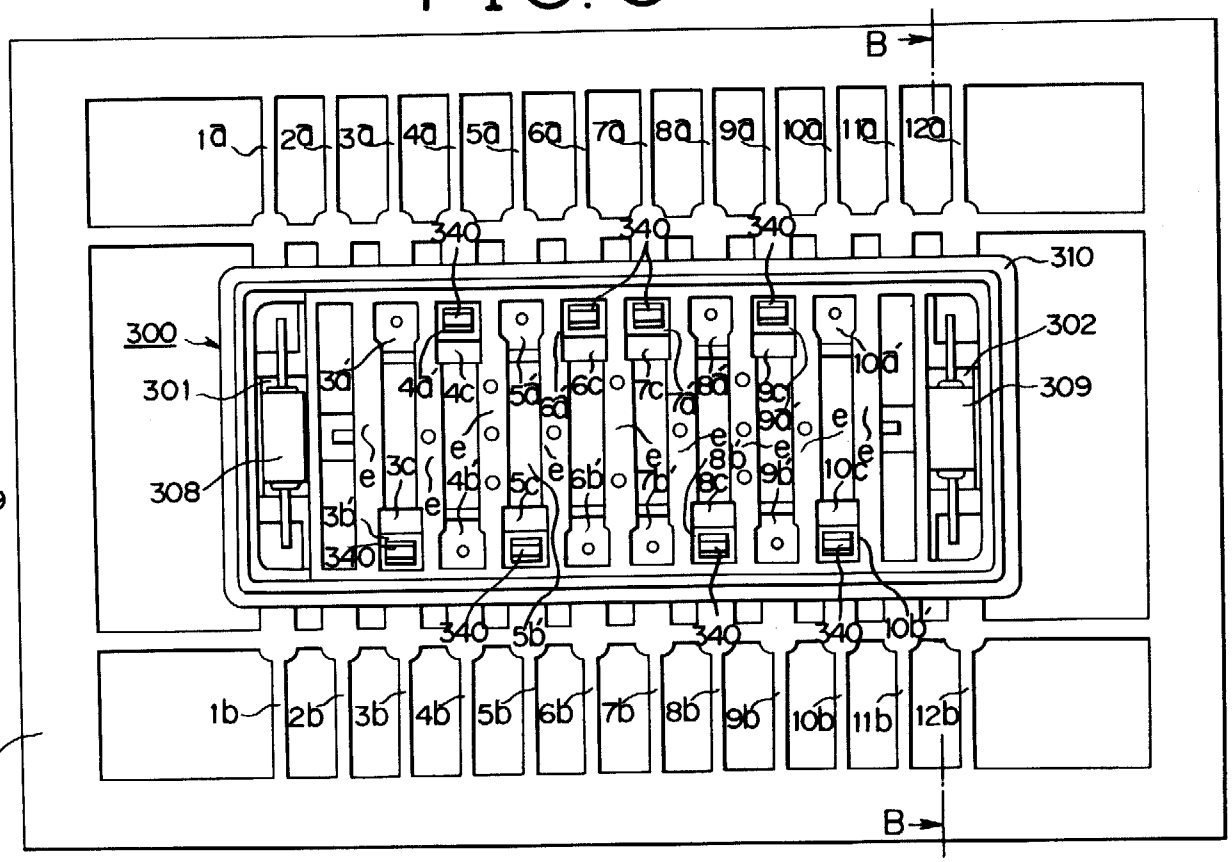
FIG. 6 is a bottom plan view showing the device of FIG. 4.
Figure 7:
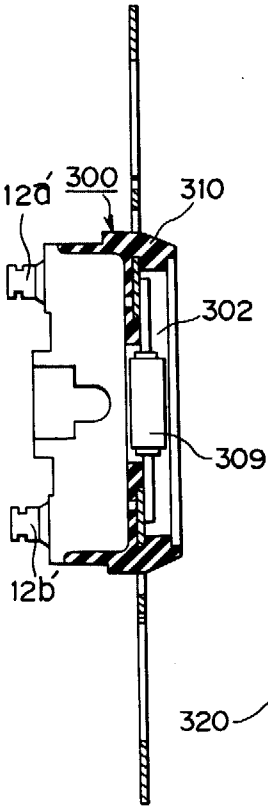
FIG. 7 is a front sectional view taken along the line B-B of the device of FIG. 6.
Figure 8:
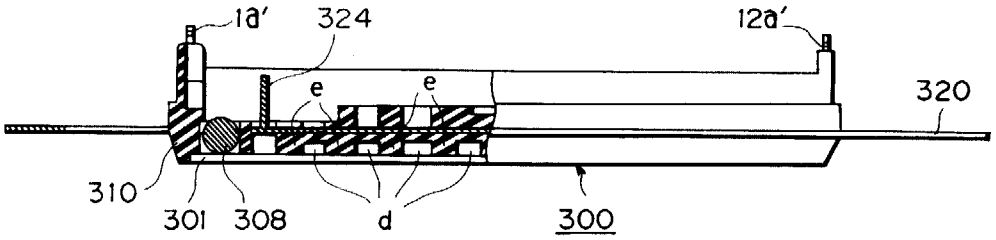
FIG. 8 is a side partially sectional view of the device of FIG. 4.

As shown by broken lines in FIG. 4, the external terminals are cut out from the plate 320 and bent in the shape shown in FIG. 1. If necessary, a common portion, such as a portion 321 between 6*b* and 7*b*, may be left uncut to provide a make-and-break-contact circuit.

As another embodiment of the present invention, pairs of movable and stationary contact members may be disposed in other modified arrangements. For example, all movable contact members may be arranged in the same direction so that make-contact only or break-contact only may be provided. Or the base of each movable contact member may be disposed near the longitudinal centerline of the base (310 in the embodiment shown in the drawings and the free end thereof be arranged adjacent to both sides of the base of the contact circuit device. Alternatively, each pain of movable and stationary contact members may be mounted on the upper surface of the base of the contact circuit device, so that when the projections positioned in a lower position depress the movable contact members, the movable contact members will come in contact with the corresponding stationary contact members.

Moreover, the external terminals may be arranged to extend from the lower surface of the contact circuit device.

In the foregoing embodiments, the plate member carries the permanent magnet which urges the plate member toward its original position as a resetting member. Alternatively, the plate member may be of the construction having a resetting spring in place of the permanent magnet.

As still another embodiment of the present invention, a plate member carrying a soft magnet bar may be mounted over an electromagnet, wherein the plate member is fixed to, and the electromagnet having projections is swingably mounted on, a contact circuit device.

It should be understood the above description is merely illustrative of the present invention and that many changes and modifications may be made by those skilled in the art without departing from the scope of the appended claims.

What is claimed is:

1. An electromagnetic relay having a plurality of external terminals comprising:

a flat electromagnetic device including a flat electromagnet, a plate member positioned opposite to said electromagnet, at least a portion of said plate member consisting in a magnetic member so that said magnetic member and electromagnet may be attracted toward each other upon energization of said electromagnet and at least one projecting member formed in said electromagnet or said plate member, said projecting member being disposed for a substantially vertical movement thereof in response to energization of said electromagnet;

a flat contact circuit device including a base made of electrically nonconductive material, a plurality of contact member pairs, each pair consisting of an elongated movable contact member and a stationary contact member, all of said contact members being supported by said circuit device and electrically connected to corresponding external terminals, each pair of said movable and stationary contact members providing a single close-and-open switching operation, said movable contact members being arranged in parallel with each other and substantially in coplanar relation, said electromagnetic device being mounted on said contact circuit device in parallel with each other and in mutually opposed relation, whereby said movable contact members are selectively biased by engagement at free ends thereof with said projection member in a lowered position thereof and return to their original positions by disengagement from said projection member in a raised position thereof to thereby accomplish a switching function such that predetermined pairs of said movable and stationary contact members are closed or opened on energization of said electromagnet.

2. An electromagnetic relay according to claim 1, wherein a free end of at least one of said movable contact members is positioned on one of a couple of parallel and spaced-apart sides of said base with the remaining movable contact members or the free ends thereof being positioned on the other side, the movable contact member or members on one side being selectively biased by said projecting member.

3. An electromagnetic relay according to claim 1, wherein said electromagnetic device is mounted on an upper surface of said base, said plate member has a longitudinally axis of rotation which is rotatably supported by said base between said electromagnet and said base, said plate member at the portion consisting in said magnetic member being swung toward said electromagnet when said electromagnet is excited and returning to its original position when said electromagnet is not excited, and said projecting member is downwardly extending from said plate member.

4. An electromagnetic relay according to claim 1, wherein said projection member consists of a plurality of projections which are arranged adjacent to both sides of said electromagnetic device, said projections in both sides being alternately driven to bias corresponding movable contact members.

5. An electromagnetic relay according to claim 1, wherein said electromagnetic device is mounted on an upper surface of said base, said movable and stationary contact members are mounted on a lower surface of said base, said base and said electromagnetic device respectively have a plurality of openings and projections so that said projections selectively pass through said openings to depress corresponding movable contact members downwardly thereby disengaging the same from stationary contact members.

6. An electromagnetic relay according to claim 1, wherein said movable and stationary contact members are mounted on a lower surface of said base, and said base on the lower surface has a plurality of walls to provide a free space between each neighboring pair of said movable and stationary contact members.

7. An electromagnetic relay according to claim 6 further comprising a pair of upper and lower cover members respectively covering said electromagnetic device and a lower surface of said contact circuit device, wherein said walls each contacts an inner surface of said lower cover so as to provide a plurality of closed compartments, so that each pair of said movable and stationary members is independently enclosed in each of said closed compartments.

8. An electromagnetic relay according to claim 6, wherein said base has on an upper surface thereof a rib in the direction crossing said walls at right angles.

9. An electromagnetic relay according to claim 1, wherein said base comprises a longitudinary elongated shield-reinforcing metal plate which is molded therein, said shield-reinforcing metal plate being electrically connected to at least one of said external terminals.

10. An electromagnetic relay according to claim 9, wherein said shield-reinforcing metal plate has a plurality of apertures, said apertures being filled up with a portion of said base.

11. An electromagnetic relay according to claim 9, wherein said shield-reinforcing metal plate has a projecting tongue extending therefrom through an upper surface of said base, said projecting tongue being positioned to contact a core of said electromagnet.

12. An electromagnetic relay according to claim 3, wherein said base has a side wall on a periphery of said upper surface thereof and said side wall has a pair of recesses on an inner surface thereof for rotatably supporting said axis of plate member.

13. An electromagnetic relay according to claim 1, wherein said external terminals are arranged in a dual-in-line package configuration by extending sideways from both side walls of said base and, then, downwardly.

14. An electromagnetic relay according to claim 1 further comprising a cover member to cover a lower surface of said contact circuit device, said cover member being made of magnetic material.

15. An electromagnetic relay according to claim 1, wherein said contact circuit device includes a pair of upper and lower covers respectively covering upper and lower surfaces, thereof, said covers being adapted to engage said base at periphery thereof, the joint of said base and said covers being sealed with adhesive material, so that said relay is hermetically sealed as a whole.

* * * * *